US007735411B2

(12) United States Patent
Bubits

(10) Patent No.: US 7,735,411 B2
(45) Date of Patent: Jun. 15, 2010

(54) PISTOL WITH SEMI-RIGID LOCKING

(75) Inventor: Wilhelm Bubits, Brunn/Gebirge (AT)

(73) Assignee: Caracal International LLC, Abu Dhabi (AE)

( * ) Notice: Subject to any disclaimer, the term of this patent is extended or adjusted under 35 U.S.C. 154(b) by 656 days.

(21) Appl. No.: 10/589,939

(22) PCT Filed: Feb. 28, 2005

(86) PCT No.: PCT/IB2005/000495

§ 371 (c)(1),
(2), (4) Date: Jun. 28, 2007

(87) PCT Pub. No.: WO2005/093361

PCT Pub. Date: Oct. 6, 2005

(65) Prior Publication Data

US 2007/0256344 A1 Nov. 8, 2007

(30) Foreign Application Priority Data

Mar. 4, 2004 (AT) ..... A 358/2004

(51) Int. Cl.
*F41A 3/86* (2006.01)

(52) U.S. Cl. ..... 89/196; 89/162

(58) Field of Classification Search ..... 42/7, 42/14, 16, 17, 70.01, 70.02; 89/141, 145, 89/153, 196, 162
See application file for complete search history.

(56) References Cited

U.S. PATENT DOCUMENTS 1,431,979 A 10/1922 Pomeroy
1,985,493 A * 12/1934 Gebauer et al. ..... 89/169
2,705,847 A * 4/1955 Kramer ..... 42/7
2,921,503 A * 1/1960 Browning ..... 89/195
3,158,064 A * 11/1964 Charron ..... 89/196
3,564,967 A * 2/1971 La Violette et al. ..... 89/163
5,309,815 A * 5/1994 Moller et al. ..... 89/163
5,347,912 A * 9/1994 Gathoye ..... 89/169
5,581,046 A * 12/1996 Weldle et al. ..... 89/196
5,654,519 A * 8/1997 Albrecht et al. ..... 89/163

(Continued)

FOREIGN PATENT DOCUMENTS

DE 721702 6/1942

(Continued)

*Primary Examiner*—Michael Carone
*Assistant Examiner*—Michael D David
(74) *Attorney, Agent, or Firm*—Greer, Burns & Crain, Ltd.

(57) ABSTRACT

A pistol including a grip, a barrel slide movable on the grip in a firing direction, and a barrel capable of being interlocked with the barrel slide. A first locking device includes a projection provided on the outer contour of the barrel and has a forward-facing first inclined surface. A second locking device includes a lever pivotably guided in the barrel slide and a dog having a rearward-facing, second inclined surface cooperating with the first inclined surface. The unlocking means includes a stop that is provided in the grip and cooperates with a lug of the barrel. When the barrel impacts against the stop and the barrel slide continues its movement, the inclined surfaces slide relative to each other, and the lever is pivoted against the force of a spring such that the dog releases the barrel slide.

11 Claims, 4 Drawing Sheets

U.S. PATENT DOCUMENTS

Figure 1:
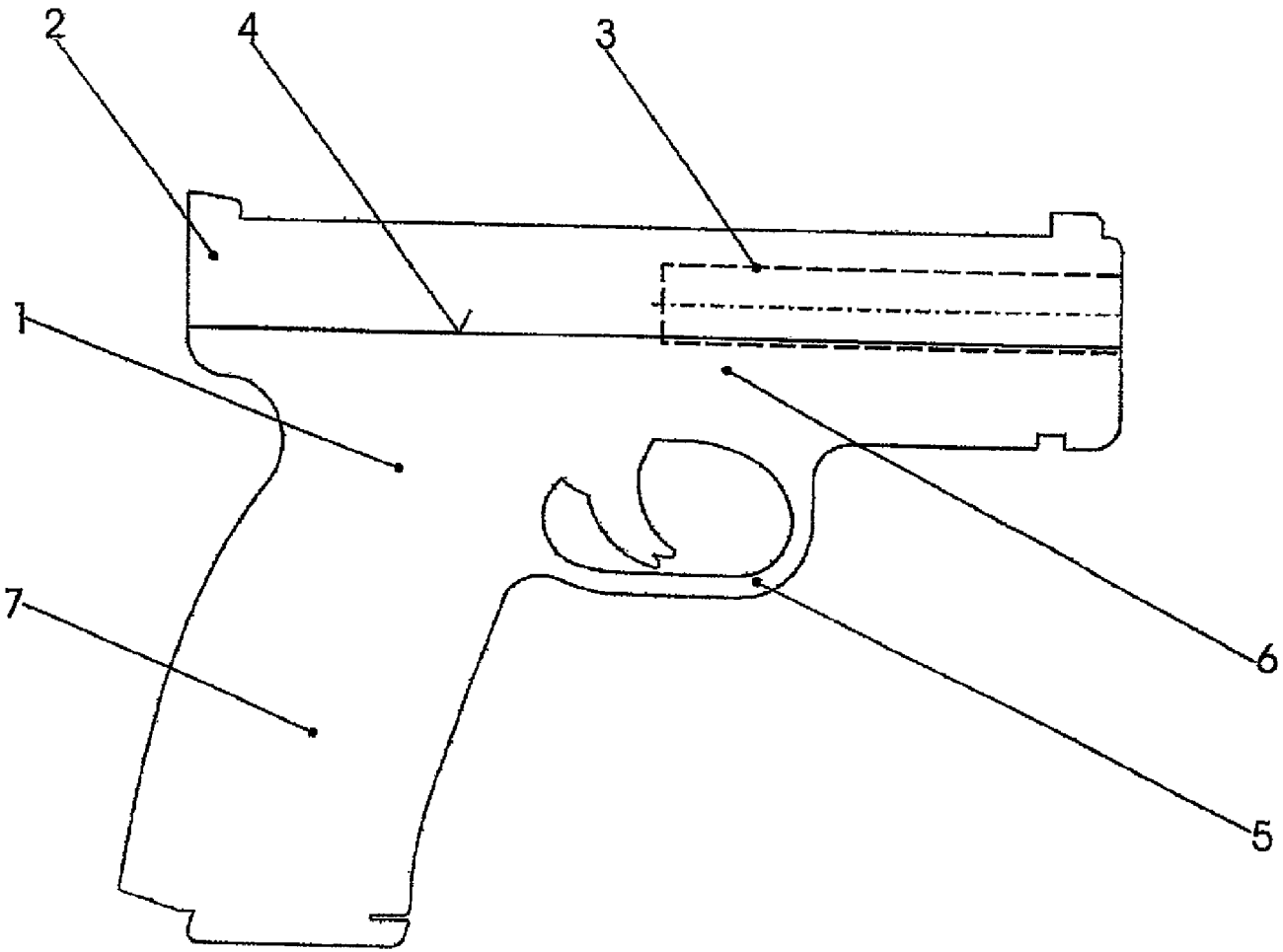

| | | | | |
|---|---|---|---|---|
| 5,827,991 | A * | 10/1998 | Predazzer | 89/161 |
| 6,212,991 | B1 * | 4/2001 | Frazier, III | 89/196 |
| 7,340,987 | B1 * | 3/2008 | Williams | 89/196 |
| 7,559,166 | B2 * | 7/2009 | Bubits | 42/7 |
| 7,571,672 | B1 * | 8/2009 | Williams | 89/196 |
| 2007/0012170 | A1 * | 1/2007 | Spielberger | 89/196 |

FOREIGN PATENT DOCUMENTS

| | | | |
|---|---|---|---|
| DE | 3109730 | A1 | 11/1982 |
| DE | 3248453 | A1 | 7/1984 |
| FR | 348625 | | 4/1905 |

* cited by examiner

PISTOL WITH SEMI-RIGID LOCKING

The invention relates to pistols comprised of a grip, a barrel slide displaceable thereon in the direction of fire, and a barrel lockable with the barrel slide, first locking means being provided on the barrel, second locking means being provided in the barrel slide, and unlocking means being provided in the grip. More precisely, these are also termed self-loading pistols because after each shot a new round is automatically loaded, irrespective of whether these are individual shots or a sustained fire, and irrespective of the type of firing mechanism used.

From DE 43 41 131 A1, e.g., such a pistol of very common construction is known. Therein, the barrel has elevations on its upper side which, in the locked state, fit into correspondingly shaped portions in the barrel slide. On its lower side, the barrel has a lug with a detent into which a barrel catch provided with a control profile engages. The cooperation of detent and control profile pulls the rear part of the barrel downwards, thereby unlocking it. Producing the detent and control profile with the precision required is only possible with difficulties and at high costs. They require construction space below the barrel, whereby the barrel lies substantially above the hand of the person firing, resulting in an increased tilting moment at firing. Yet, particularly the reaction forces of the eccentric force action and from the tilting movement of the barrel are annoying, they render handling more difficult and negatively affect the accuracy of fire.

The invention aims at counteracting these disadvantages. A pistol of the defined type is to be provided, the locking of which is simple, inexpensive and space-saving and which has a convenient, straight-line recoil behavior.

According to the invention, this is achieved in that the first locking means is a projection provided on the outer contour of the barrel and having a forward-facing first inclined surface, in that the second locking means is a lever pivotably guided in the barrel slide and including a dog having a rearward-facing, second inclined surface cooperating with the first inclined surface, and in that the unlocking means is a stop provided in the grip and cooperating with a lug of the barrel. There, the angle of inclination of a normal line on the inclined surfaces relative to the firing direction and the position of the pivot point of the lever are chosen such that when the barrel impacts against the stop and the barrel slide continues its movement, the inclined surfaces are capable of sliding off each other, and the lever is pivoted against the force of a spring such that the dog releases the projection on the outer contour of the barrel and, thus, the barrel slide for the continued rearward movement.

In this way, at first it is achieved that the barrel will move only in the firing direction, without any vertical component, whereby the above-mentioned reaction forces and moments will not occur. The projection on the barrel and the lever can be produced with little expenditures, merely the two inclined surfaces are demanding in terms of precision and quality of machining. The lever does not require a forced guide, it is only pressed on by a spring, without any additional control faces or detents, and by the kinetic energy of the returning barrel slide it is rapidly thrown into the opened, unlocked position. The lever can be pivotable about a fixed axis or guided in any other way. In any case, the space required by the lever transversely to the firing direction is small, which is beneficial to the outer dimensions of the pistol.

More precisely, the angle of inclination of the inclined surfaces relative to the direction of movement of the barrel is intended to be larger than the angle of friction at a friction occurring between the two inclined surfaces. Here, the friction factor $\mu$ is equal to the tangent of the angle of friction.

Preferably, the lever is a two-armed lever having its axis of rotation located behind the inclined surface, whose forward-directed arm carries the dog and whose rearward-directed arm presses a spring towards the outside; the spring is a leaf spring; and the projection is arranged on the outer contour of the barrel on the rear end thereof. This results in a compact construction and short paths of power flux.

In a further development of the invention, in addition to the stop forming the unlocking means, a further stop is provided in the grip, which further stop also cooperates with the lug of the barrel, the clear distance in the longitudinal direction between the stop and the further stop being larger than the length of the lug by a certain amount. In a most simple manner, this amount determines the distance of the return movement of the barrel until it is unlocked, which thanks to the nature of the invention, can be a very short one. If this further stop is designed to be retractable, it will serve as a dismantling lock, and after its opening, the barrel can be pulled out.

In the preferred embodiment of the inventive pistol, the barrel has two lateral projections, a pivotably guided lever is provided on either side, and the unlocking means are arranged below the barrel. By the symmetrical lateral arrangement of the levers, also the locking forces act symmetrically on the barrel, and the vertical distance of the barrel axis from the hand of the person firing is minimized. Since the levers are flat elements, the width of the pistol is not increased thereby. A particularly narrow construction is achieved if the levers are located in lateral through-holes of the barrel slide.

Figure 5:
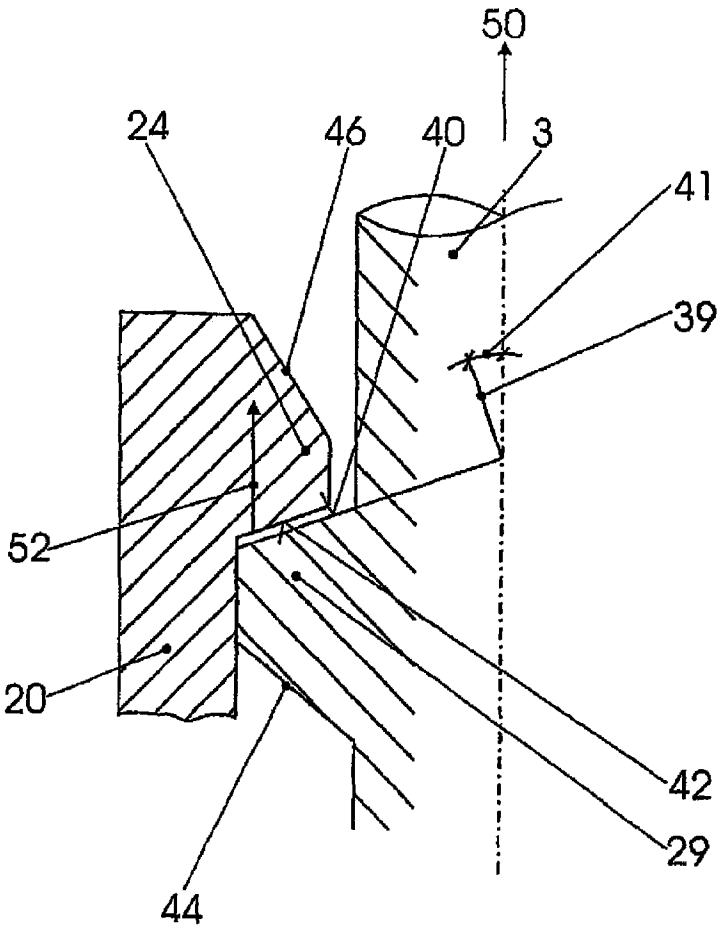

In the following, the invention will be described and explained by way of illustrations. Therein, FIG. 1 shows a side view of a pistol according to the invention, FIG. 2 shows an enlarged and partially sectioned detail of FIG. 1, FIG. 3 shows a section according to III-III of FIG. 2, FIG. 4 shows a cross-section according to IV-IV of FIG. 3, FIG. 5 shows detail V of FIG. 3, enlarged.

In FIG. 1, a pistol according to the invention is only quite schematically shown. It consists of a grip 1, a barrel slide 2 and a barrel 3. The upper part of the grip 1 constitutes a housing 6 with a guide 4 in which the barrel slide 2 is displaceable in longitudinal direction (i.e., firing direction). The housing 6 downwardly passes over into a trigger guard 5 and into a handling part 7. The barrel 3 is movably guided in the barrel slide 2, as is schematically shown.

Figure 2:
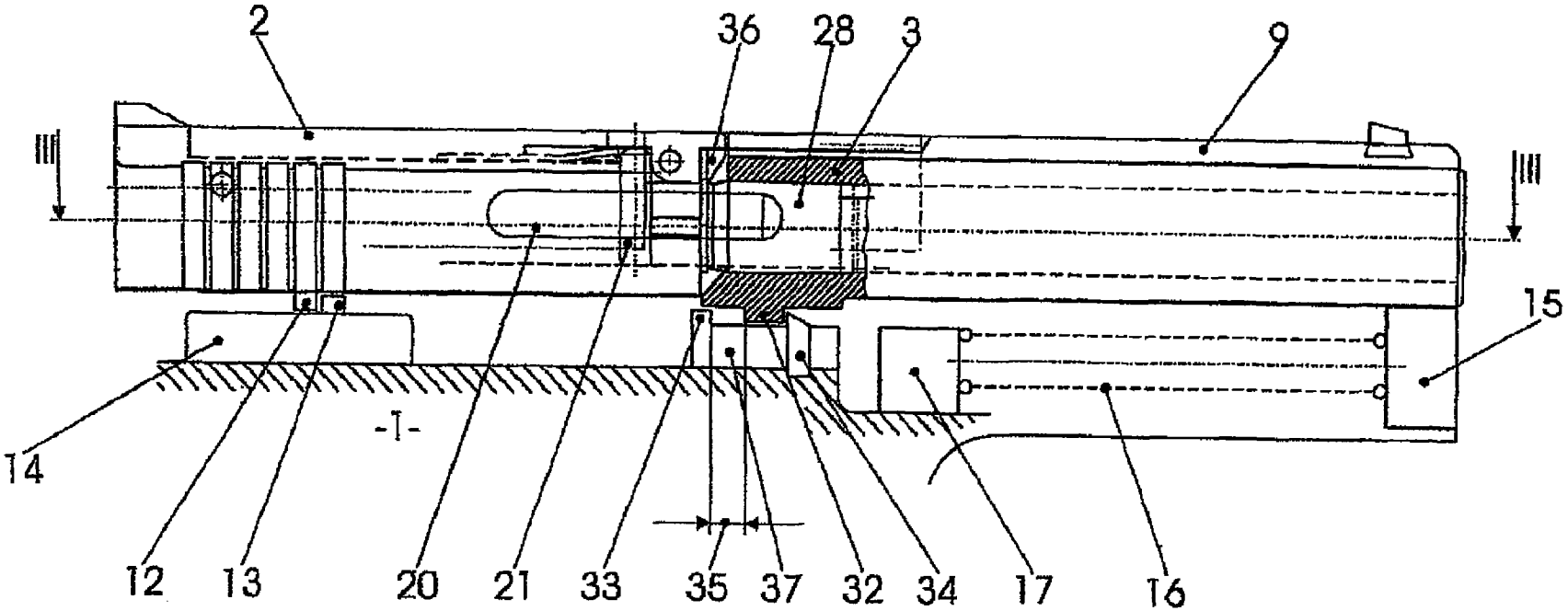
Figure 3:
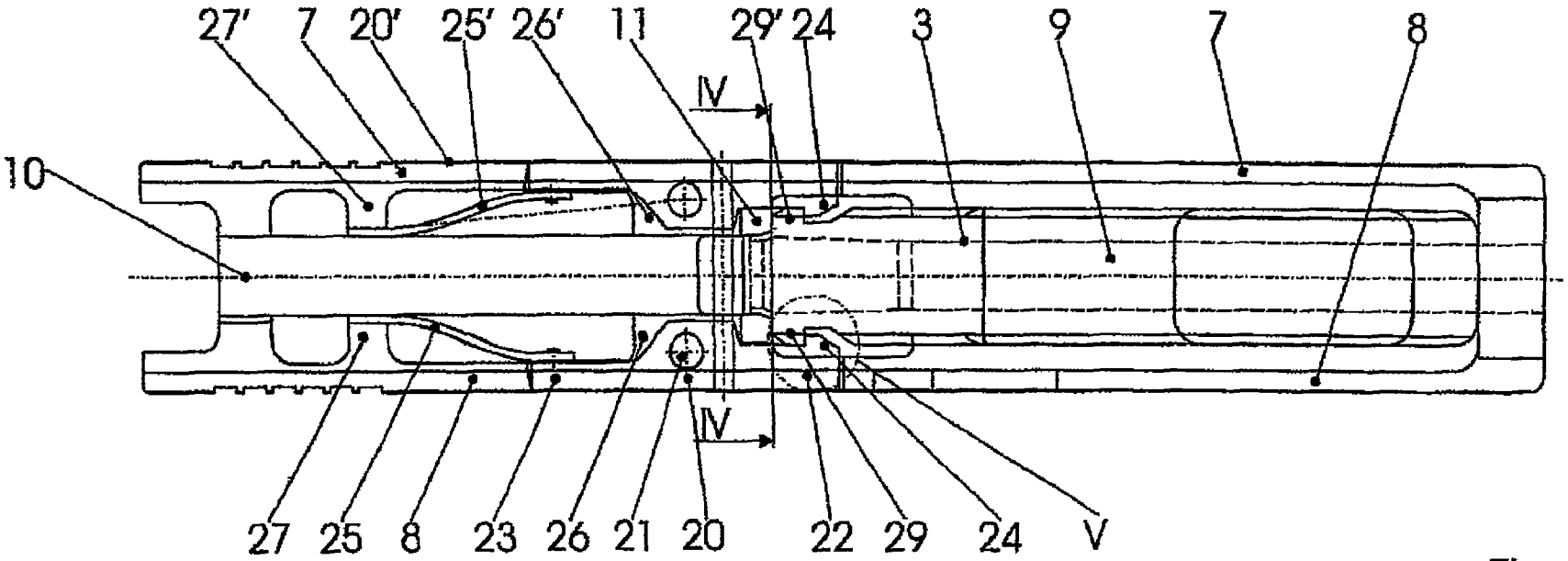
Figure 4:
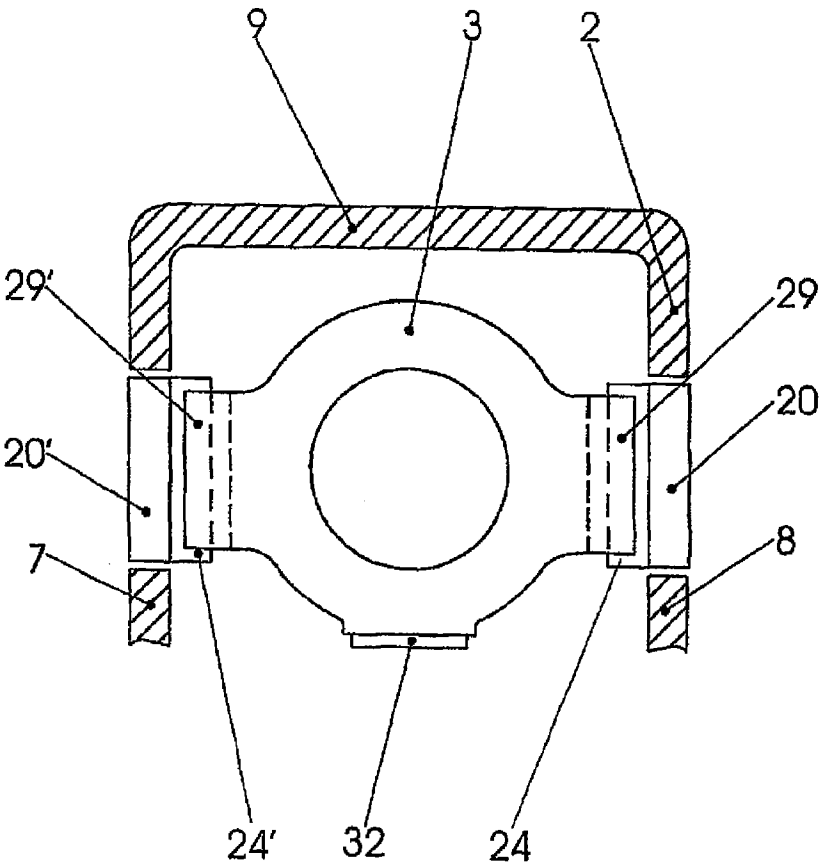

In FIGS. 2, 3 and 4, the barrel slide 2, the barrel 3 and their locking are illustrated in more detail. Elements attached to the grip 1 are visible only insofar as they have a connection to the locking according to the invention. The barrel slide 2 is a member of substantially rectangular cross-section, said member extending over the length of the entire pistol. It consists of a left-hand side wall 7, a right-hand side wall 8, and a top wall 9 (cf. FIG. 4). In its rear portion it contains a breech part 10 including, e.g., a striker with its associated parts (not illustrated). Only a striker lug 12 and a sear 13 actuated via a merely schematically indicated trigger mechanism 14 are shown. At its front end, the breech part 10 forms a breech block 11 against which the barrel 3 abuts in the locked state thereof. At its front end, the barrel slide 2 has a front plate 15 guiding the barrel 3, a closing spring 16 resting with one end thereof against said front plate. Its other end abuts against an abutment 17 fastened in the grip.

In the side wall 8 of the barrel slide 2, a lever 20 is accommodated, and in the exemplary embodiment illustrated, an equal lever 20' is provided in the other side wall 7. These levers are arranged in through-holes in the side walls 7, 8 of approximately the same contour for reducing the width of the barrel slide. The levers 20, 20' are two-armed levers having their pivot axis 21 vertically arranged in eyes 26 of the barrel slide. The front arm 22 (and 22') forms an inwardly directed dog 24 at its end. The rear arm 23 is pressed outwards at its end by a leaf spring 25 (and the dog 24, thus, is pressed inwards), the other end of said leaf spring being held on an inner projection 27 of the barrel slide 2. The eyes 26 and projections 27 here also serve to hold the breech part 10.

On its end facing the breech block 11, the barrel 3 has a chamber 28 for rounds and, externally, it has lateral projections 29, 29'. During locking of the barrel slide 2 and the barrel 3, these projections 29 cooperate with the dogs 24 in a manner yet to be described. For locking, a single lever would suffice in the exemplary embodiment illustrated, however, two levers are provided, a respective one being symmetrically arranged on either side. The further member required for locking and unlocking, respectively, is a lug 32 on the lower side and close to the rear end of the barrel 3, which lug 32 cooperates with a stop 33 fixed on the housing. The stop projects upwards from a bridge 37 arranged in the grip 1, in which bridge a further stop 34 is vertically displaceably guided at a more forwardly located site.

The stop 34 can be pulled back by means of a (non-illustrated) dismantling lever so as to be able to pull off the barrel and to subsequently enable disassembling of the pistol. It is visible that the length of the lug 32 is less than the distance between the stop 33 and the further stop 34. The difference 35 is the path which the barrel 3 passes with the barrel slide 2 towards the rear side until, when having reached the stop 33, the connection between barrel slide 2 and barrel 3 is unlocked. Finally, an ejector claw 36 may be provided in the top wall 9 of the barrel slide 2.

FIG. 5 shows the cooperation of the dog 24 with the projection 29 on barrel 3 on a greatly enlarged scale. The projection 29 has a first inclined surface 40 up front, viewed in firing direction, and a first catch face 44 in the rear, viewed in firing direction. The dog 24 has a second inclined surface 42 in the rear, viewed in firing direction, and a second catch face 46 up front. The two inclined surfaces 40, 41 are parallel plane surfaces here, and their normal lines 39 on their surfaces enclose an angle 41 with the longitudinal axis of the barrel. However, the inclined surfaces could also be designed to be crowned. The angle 41 must be larger than the angle of friction whose tangent is the friction value $\mu$ between the two inclined surfaces 40, 41. It is assumed that the pole of rotation, or the pivot axis, respectively, of the lever has approximately the same distance from the plane of symmetry of the pistol as the inclined surfaces.

The two inclined surfaces have the following effect: If the barrel which, on account of the recoil action, has been thrown back opposite to the firing direction, is suddenly stopped by its lug 32 on the stop 33, the barrel slide 2 which, so far has been thrown back together with the barrel 3, will tend to continue its movement, due to its inert mass. Since the lever 20 is connected to the barrel slide 2 in the center 21 of rotation, a force 52 acts on the same which will be split up into a normal component and a tangential component on the inclined surfaces 40, 41, according to the angle 41. If the tangential component of this force is higher than the frictional force between the two inclined surfaces, the dog 24 is very rapidly pivoted outwards against the force of the spring 25, until it releases the projection 29. Now the barrel slide 2 can move further backwards. If the barrel slide 2 is pulled forwards again by the force of the closing spring 16, the catch faces 44, 46 will get into contact. With this, the dog 24 is lifted beyond the projection 29 and, on account of the spring, snaps in again in front of the projection 29 in the position illustrated in FIG. 5. Now barrel and barrel slide are interlocked again.

The invention claimed is:

1. A pistol comprising: a grip, a barrel slide movable on the grip in a firing direction, and a barrel capable of being interlocked with the barrel slide, wherein first locking means are provided on the barrel, second locking means are provided in the barrel slide, and unlocking means are provided in the grip, the first locking means is a projection provided on an outer contour of the barrel and having a forward-facing first inclined surface, the second locking means is a lever pivotably guided in the barrel slide and including a dog having a rearward-facing, second inclined surface cooperating with the first inclined surface, and the unlocking means is a stop provided in the grip and cooperating with a lug of the barrel; wherein an angle of inclination of the first and second inclined surfaces respective of the barrel and the lever are configured such that the first and second inclined surfaces slide off each other when the barrel impacts against the stop and the barrel slide continues its movement, and wherein the lever is pivoted against the force of a spring such that the dog releases the barrel slide.

2. The pistol according to claim 1, wherein an angle formed between a line that is normal to the inclined surfaces and a longitudinal axis of the barrel is larger than an angle of friction between the two inclined surfaces.

3. The pistol according to claim 1, wherein said lever is a two-armed lever having its center of rotation located behind the first and second inclined surfaces, whose forward-directed front arm carries the dog and whose rearward-directed rear arm is pressed by a spring.

4. The pistol according to claim 3, wherein said spring is a leaf spring.

5. The pistol according to claim 1, wherein said projection is provided on the outer contour of the barrel at a rear end thereof.

6. The pistol according to claim 1, further comprising a further stop provided in the grip, that cooperates with the lug of the barrel wherein a distance in the longitudinal direction between the stop and the further stop is greater than a length of the lug by a designated amount, wherein said designated amount determines the distance of the return movement of the barrel until it is unlocked.

7. The pistol according to claim 6, wherein said further stop is retractable.

8. The pistol according to claim 1, wherein said barrel has two lateral projections, one on either side, in that a pivotably guided lever is provided on either side, and in that the unlocking means are arranged below the barrel.

9. The pistol according to claim 8, wherein said levers are located in lateral through-holes of the barrel slide.

10. The pistol according to claim 8, wherein a breech part is fastened in the barrel slide, an ejector claw being arranged on the upper front edge of said breech part.

11. The pistol according to claim 1, wherein the first locking means includes two projections provided on the outer contour on opposing sides of the barrel, each said first locking means having a forward-facing first inclined surface, the second locking means including two levers that are each pivotably guided in the barrel slide and include a dog having a rearward-facing, second inclined surface cooperating with the respective first inclined surfaces of the first locking means, wherein an angle of inclination of the first and second inclined surfaces respective of the barrel and the lever are configured such that the first and second inclined surfaces slide off each other when the barrel impacts against the stop and the barrel slide continues its movement, and wherein each of the levers is pivoted against the force of a spring such that each dog releases the barrel slide.

* * * * *